US006112808A

United States Patent [19]

Isted

[11] Patent Number: 6,112,808

[45] Date of Patent: Sep. 5, 2000

[54] METHOD AND APPARATUS FOR SUBTERRANEAN THERMAL CONDITIONING

[76] Inventor: Robert Edward Isted, #6, 6125 -11th Street SE, Calgary, Alberta, Canada, T2H 2L6

[21] Appl. No.: 08/934,340

[22] Filed: Sep. 19, 1997

[51] Int. Cl.[7] ..... E21B 43/24

[52] U.S. Cl. ..... 166/60; 166/66.5; 166/248

[58] Field of Search ..... 166/248, 66.5, 166/60

[56] References Cited

U.S. PATENT DOCUMENTS

| | | | |
|---|---|---|---|
| 3,547,193 | 12/1970 | Gill | 166/248 |
| 3,824,364 | 7/1974 | Cachat | 219/10.51 |
| 4,008,761 | 2/1977 | Fisher et al. | 166/248 |
| 4,043,393 | 8/1977 | Fisher et al. | 166/248 |
| 4,344,483 | 8/1982 | Fisher et al. | 166/248 |
| 4,484,627 | 11/1984 | Perkins | 166/248 |
| 4,489,782 | 12/1984 | Perkins | 166/248 |
| 4,538,682 | 9/1985 | McManus et al. | 166/255 |
| 4,951,748 | 8/1990 | Gill et al. | 166/248 |
| 5,099,918 | 3/1992 | Bridges et al. | 166/60 |
| 5,233,304 | 8/1993 | Hubans | 324/323 |
| 5,282,508 | 2/1994 | Ellingsen et al. | 166/249 |
| 5,293,936 | 3/1994 | Bridges | 166/248 |
| 5,323,855 | 6/1994 | Evans | 166/248 |
| 5,361,845 | 11/1994 | Jamaluddin et al. | 166/302 |
| 5,366,623 | 11/1994 | Clair | 210/222 |
| 5,454,943 | 10/1995 | Ashton et al. | 166/66.5 |
| 5,465,789 | 11/1995 | Evans | 166/248 |
| 5,539,853 | 7/1996 | Jamaluddin et al. | 392/302 |

FOREIGN PATENT DOCUMENTS

| | | | |
|---|---|---|---|
| 866574 | 3/1971 | Canada | 166/35 |
| 2090629 | 9/1994 | Canada . | |
| 2010954 | 4/1994 | Russian Federation | 166/60 |
| 1298354 | 3/1987 | U.S.S.R. | 166/60 |

OTHER PUBLICATIONS

Copy of Pages 1 of 2, 2 of 2, and 3 of search report in corresponding PCT patent appliction No. PCT/CA 98/00587.

Abstract of U.S. Patent No. 5,621,845, issued Apr. 15, 1997, 2 pages.

Abstract of U.S. Patent No. 4,645,004, issued Feb. 24, 1987, 3 pages.

Abstract of U.S. Patent No. 4,545,435, issued Oct. 8, 1985, 3 pages.

Abstract of U.S. Patent No. 4,524,827, issued Jun. 25, 1985, 3 pages.

Abstract of U.S. Patent No. 4,498,535, issued Feb. 12, 1985, 2 pages.

Abstract of U.S. Patent No. 4,485,869, issued Dec. 4, 1984, 2 pages.

Abstract of U.S. Patent No. 4,485,868, issued Dec. 4, 1984, 2 pages.

Abstract of U.S. Patent No. 4,476,926, issued Oct. 14, 1984, 2 pages.

Abstract of U.S. Patent No. 4,449,585, issued May 22, 1984, 2 pages.

Abstract of U.S. Patent No. 4,144,935, issued Mar. 20, 1979, 2 pages.

Abstract of U.S. Patent No. RE30,738, issued Sep. 8, 1981, 2 pages.

Abstract of U.S. Patent No. 4,140,180, issued Feb. 20, 1979, 2 pages.

Abstract of U.S. Patent No. 3,954,140, issued May 4, 1976, 1 page.

*Primary Examiner*—Hoang Dang
*Attorney, Agent, or Firm*—Davis and Bujold

[57] ABSTRACT

A method and apparatus for subterranean thermal conditioning. The first step involves providing a tubular magnetic induction apparatus. The second step involves positioning the magnetic induction apparatus into a subterranean environment. The third step involves supplying voltage waves to the magnetic induction apparatus thereby inducing a magnetic field in and adjacent to the magnetic induction apparatus to thermally condition the subterranean environment. This method and apparatus has application in the petroleum and mining industries.

4 Claims, 19 Drawing Sheets

METHOD AND APPARATUS FOR SUBTERRANEAN THERMAL CONDITIONING

FIELD OF THE INVENTION

The present invention relates to a method and apparatus for subterranean thermal conditioning.

BACKGROUND OF THE INVENTION

It has long been recognized in the petroleum industry that addition of heat to the productive interval in oil wells can be very beneficial to stimulating and maintaining the production rates of high viscosity heavy oil and waxy oil.

Steam injection is used extensively, but has certain inherent characteristics that makes it disadvantageous to use under certain circumstances. For example, some oil bearing reservoirs also contain clay minerals which swell in contact with fresh water. This swelling damages the permeability of the reservoir rock and, therefore, its fluid productivity. In many oil producing regions, fresh water supplies for generating steam are limited. The condensed water from the injected steam that is produced with the reservoir fluids must be separated and extensively treated to reuse it for steam generation or to dispose of it to near-surface aquifers. In oil reservoirs that are more than a few meters thick, injected steam enters the reservoir at its most permeable point, thus heating the region near that point, but leaving large sections of exposed productive reservoir unheated.

An electrical heating system for well conditioning does not need water injection thereby eliminating clay swelling permeability problems, water supply, treating, and disposal as considerations and the addition of heat may be beneficial in reducing existing clay swelling. On the other hand the system may use water, convert water to steam or use other fluid, if advantageous to increase production, to destroy contaminants, to promote fracturing or otherwise condition the well. The invention may be of any required length and be configured to have variable or constant heat release along the length thereby enabling heating of the entire productive zone, and beyond, at variable total as well as variable incremental heat rates consistent with requirements.

Several configurations of electrical apparatus have been proposed and tested in the field to thermally stimulate oil producing reservoirs. One of the first methods implemented was the suspension of electrical resistance heating elements on an electrical power cable across from the interval to be heated. Electrical current is delivered through the cables to the resistance elements causing the resistance elements to increase in temperature in proportion to their electrical resistance and the square of the electrical current passing through them. Heat is transferred to the produced fluid by convection from the surface of the resistance elements, thereby raising the temperature of the fluid in the well annulus. This increase in temperature causes some heat to be transferred by conduction through the wall of the well's production casing, or liner, to the near wellbore region of the reservoir. The temperature rise in the near wellbore region causes a reduction in the viscosity of the oil flowing in that region, with a consequent reduction in pressure drop there and an increase in productivity due to the reduction in flow resistance. In order to transfer a significant amount of the heat from the resistance element surface to the near wellbore reservoir region, a very high surface temperature must be generated. High surface temperatures cause thermal coking of petroleum product and degradation of insulating and other material with consequent failure of the device. As a result, this type of electrical heater is no longer commonly used in the petroleum industry.

Another type of electrical heating device that has been extensively tested in the field involved the isolation of one or more electrodes in the well production casing, or liner string, which are used to conduct electrical current via the connate water or conductive material in the reservoir. With this type of device, the electrical resistivity of the reservoir itself is utilized as a heating element. Again the heat generated within a specific location is proportional to the resistance and the square of the current passing through that region. Several configurations of equipment have been proposed and tested to effect near wellbore heating in this way. One uses production casing in the well with a coating of electrical insulation added to its surface except for the region where the current is to pass to the reservoir. Electrical current is passed to the reservoir by connecting one pole of an AC electrical power source to the production casing and the other pole to a ground electrode. These systems proved to be impractical because of difficulties in maintaining a perfectly impermeable electrically insulating membrane on a long string of production casing that must withstand rough handling in the field and extremes of temperature during installation. In addition, the insulation degrades quickly due to overheating causing the system to become inefficient and ineffective after an impractically short period of operation. This method also required completion of the subject well in a specific manner such that installation in an existing well is impractical in most instances.

Other system configurations based on the concept of passing electrical current into the reservoir via electrodes use two or more sections of electrically non-conducting materials inserted in the casing string to isolate the electrode (s). With these configurations, AC electrical power is conducted to the electrodes by a power cable or by the well's production tubing that has been suitably insulated for the purpose. While the published results of field tests of these electrode systems have shown considerable promise for effectively stimulating oil production, the systems have been prone to premature failure and have several major inherent disadvantageous characteristics which have limited their acceptance by the petroleum industry. One inherent problem with electrode systems is that they require either a new well with a completion designed especially for the system or a very extensive and often impractical re-working of an existing well. Another problem is that oil reservoirs are not homogeneous and are often formed of layers of sediment having differing physical characteristics. Layers of sediment with differing physical characteristics, respond differently to thermal conditioning. With present systems this inevitably leads to uneven heating, as they lack the ability to differentiate between layers. The least productive layers, which typically have low resistance, conduct most of the current such that the required voltage for a reasonable release of heat in such layers, is inadequate to effectively heat the production layers which are typically composed of high resistance material. A further limiting characteristic of the method is the highly non-linear voltage gradient existing at the interface between the electrode and isolation section. Most of the energy is released near the ends of the electrodes resulting in high temperatures in a local area with little increase in temperature over the bulk of the electrode. In order to release enough heat to stimulate productivity the electrode to isolator connection can reach uncontrollably high temperature levels causing failure of the electrode and/or adjacent insulating and completion materials. Electrode systems require the use of single phase alternating current with the return current external to the supply cable. Alternating current is used rather than direct current in order to maintain electrolytic corrosion in the well to an acceptable level. Electrode systems that utilize either a power cable or an insulated tubing string to deliver power to the electrodes can be operated at AC frequencies below normal power frequencies. This is done to minimize overheating that can occur in the power delivery system due to the induced currents that are generated in the ferromagnetic tubulars of the well and accessories. Despite operating at quite low frequencies, damaging overheating can result due to the high current required to deliver significant power with the low resistance common with this configuration. Electrode systems are fundamentally limited in the combined length of the electrodes being used, and, therefore, the thickness of exposed reservoir face that can be heated. The reason for this is that the efficiency of the electrode system is determined by the ratio of the electrical impedance of the electrode divided by the electrical impedance of the entire system. The impedance of the electrode is inversely proportional to its length and a function of the electrical resistivity of the reservoir formation in contact with the electrode. The resistivity of oil bearing formations varies greatly depending primarily on its porosity and its saturation with oil, water and gas. Also, the resistivity of the formation declines as its temperature increases, therefore, the impedance of the electrode and the efficiency of the system declines as the formation temperature increases. One particularly intractable problem with electrode systems is that electrical tracking seems to occur inevitably across the surface of insulators exposed to the produced fluids from the wells. These fluids are often composed of two liquid phases, oil and salt water. At and below the electrical potential differences used in these systems the movement of a stream of conductive salt water across the isolating section causes sparking which initiates a carbon track as the stream of conductive liquid breaks or makes contact with the metallic elements on either end of the insulator. With each spark additional conductive material is deposited that effectively extends the track thereby reducing the length of the isolating section until a flash over renders the system inoperative. A similar phenomenon may take place within the reservoir, thus adversely affecting the reservoir characteristics and causing unstable electrical operating conditions. If operations continue, production casing or isolator failure can occur, requiring abandonment or expensive recompletion of the well. Operation under these circumstances is characterized by sudden current surges which cause the failure of delivery fuses and or electrical cables. As a result of all these factors the system has a short operating life and limited application.

Horizontal wells, that is petroleum wells in which the production completion zone lies in a horizontal or near horizontal plane, generally use steam to increase productivity, with the same general limitations affecting vertical or near vertical wells. U.S. Pat. No. 5,539,853 which issued to Jamaluddin in 1996 discloses a system in which heating elements are deployed within a tubing section within the production zone with hot gasses passing over the elements and then discharging to the reservoir. Since the gases must be supplied from the surface and penetrate into the formation, a counterflow condition exists which is similar to that of steam injection. Since the ambient gravitational and reservoir pressure gradients are disrupted by the counter current flow of the steam or gas, the full effect of heat addition is compromised.

SUMMARY OF THE INVENTION

What is required is a method and associated apparatus for subterranean thermal conditioning that will be less prone to the drawbacks present in the teachings of the prior art.

According to one aspect of the present invention there is provided a method for subterranean thermal conditioning. The first step involves providing a tubular magnetic induction apparatus. The second step involves positioning the magnetic induction apparatus into a subterranean environment. The third step involves supplying voltage waves to the magnetic induction apparatus thereby inducing a magnetic field in and adjacent to the magnetic induction apparatus to thermally condition the subterranean environment.

The method described above enables controlled thermal conditioning. Due to the nature of the technology, problems that led to equipment failure or undesirable outcomes with alternative technologies are reduced or eliminated.

Although beneficial results may be obtained through the use of the method, as described above, even more beneficial results may be obtained when a further step is included of generating electromechanical vibration by means of a steep rise and fall in electrical voltage supplied to the magnetic induction apparatus, such that magnetic attraction between the magnetic induction apparatus and the ferromagnetic well casing causes relative movement with each change in electrical voltage. This imparts vibration of variable amplitude and frequency which assists in production by agitating particles so as to fluidize unconsolidated material to rearrange them to establish a more permeable flow path. It also agitates particles within the annular space so as to minimize settlement and plugging and to reduce shear forces. It helps to fluidize surrounding material when a tool becomes "sanded in", thus allowing it to be more readily extracted.

According to another aspect of the present invention there is provided an apparatus for subterranean thermal conditioning which includes a tubular housing. A magnetically permeable core is disposed in the housing. Electrical conductors are wound in close proximity to the core. Means is provided for electrically isolating the electrical conductors.

The electrical conductors for the apparatus, as described above, receives electrical power from a Power Conditioning Unit (PCU) located at the surface for the purpose of supplying electrical energy consisting of voltage waves with variable voltage and frequency so controlled to generate the desired response in the apparatus. The PCU may be equipped with computer, microprocessors and application specific logic and controls to optimize operating characteristics in response to information obtained from instruments deployed downhole with the apparatus.

Although beneficial results may be obtained through the use of the apparatus, as described above, a production zone which is to be thermally stimulated can be of a considerable length. Even more beneficial results may, therefore, be obtained when means are provided for electrically connecting a plurality of housings, each having a magnetically permeable core with electrical conductors wound in close proximity to the core, to form a magnetic induction assembly. Such a magnetic induction assembly can be made to substantially span a production zone.

Although beneficial results may be obtained through the use of the apparatus, as described above, hydrostatic pressure in deep wells can exert considerable force upon the housing.

In some cases, this force is capable of crushing the housing and damaging the components inside the housing. Even more beneficial results may, therefore, be obtained when the means for electrically isolating the electrical conductors includes an insulating liquid. The insulating liquid inside the housing helps to counteract hydrostatic pressure acting upon the exterior of the housing. An alternative, and preferred, means for electrically isolating the electrical conductors is a substantially incompressible insulating gel.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
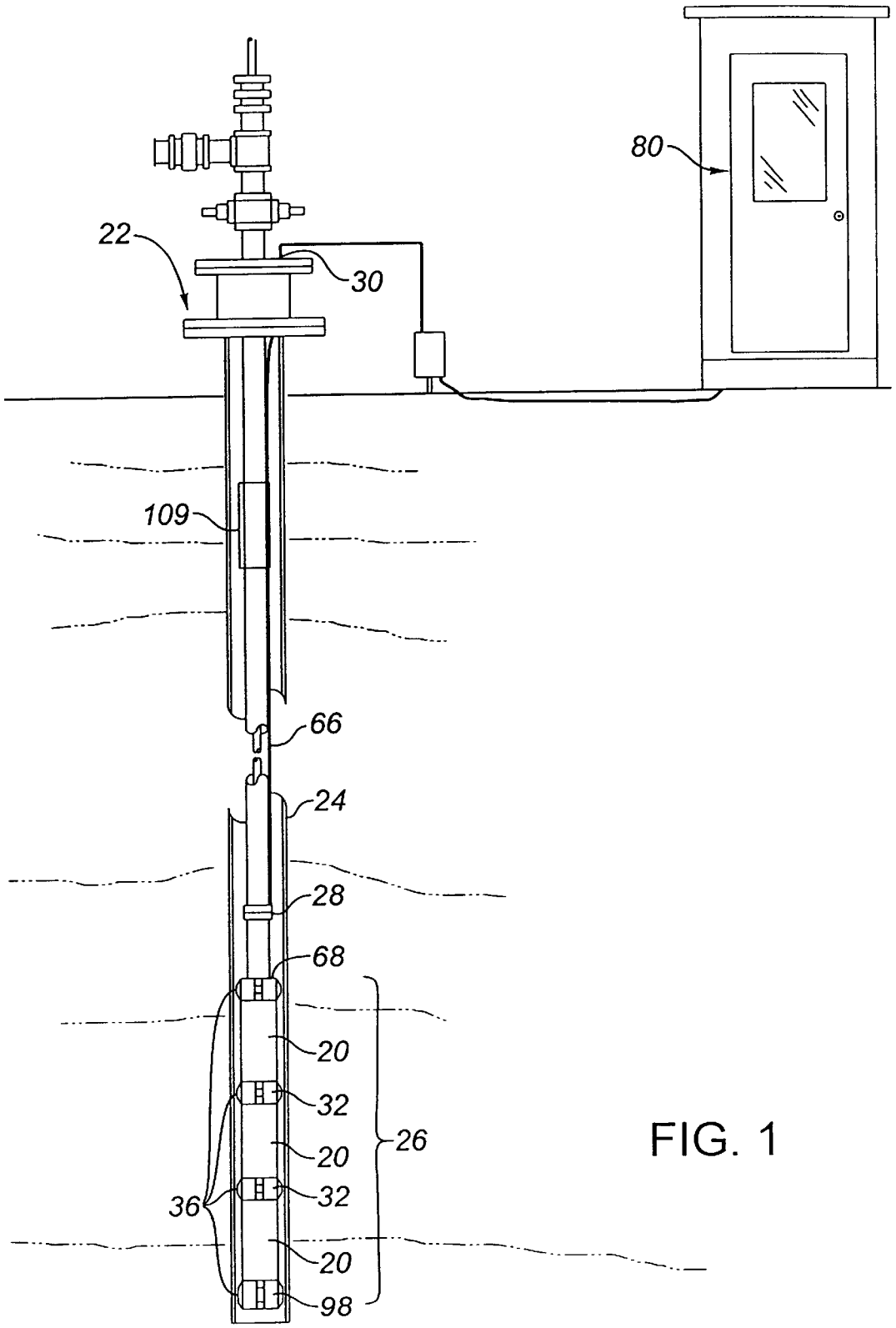
FIG. 1 is a side elevation view, in section, of a magnetic induction assembly positioned in a vertical well in accordance with the teachings of the present invention, including adapter sub, primary electrical connection, and a plurality of magnetic induction apparatus joined by means of conductive couplings.

The preferred method for thermal conditioning of an oil well will now be described with reference to FIGS. 1 and 2.

The first step involves providing one or more magnetic induction apparatus 20. The second step involves positioning magnetic induction apparatus 20 into a subterranean environment. An oil well 22 is illustrated that has a ferromagnetic well casing 24. It is preferred that more than one magnetic induction apparatus 20 be used and that they be joined together as part of a magnetic induction assembly, generally indicated by reference numeral 26. The third step involves inducing a magnetic field in and adjacent to ferromagnetic well casing 24 by means of magnetic induction apparatus 20 thereby producing heat to thermally condition oil well 22. As an adjunct or additional step to this method electromechanical vibrations may be generated by means of a steep rise and fall in electrical voltage supplied to magnetic induction apparatus 20. Magnetic attraction between magnetic induction apparatus 20 and ferromagnetic well casing 24 causes relative movement with each rise in electrical voltage. This imparts vibration that can be varied in amplitude and frequency by means of a power control unit, which will hereinafter be described in relation to the components that is preferred be included in magnetic induction assembly 26.

The preferred embodiment of magnetic induction assembly 26 will now be described with reference to FIGS. 1 through 19. Referring to FIG. 1, magnetic induction assembly 26 includes an adapter sub 28, an electrical feed through assembly 30, and a plurality of magnetic induction apparatus 20 joined by means of conductive couplings 32.

Figure 2:
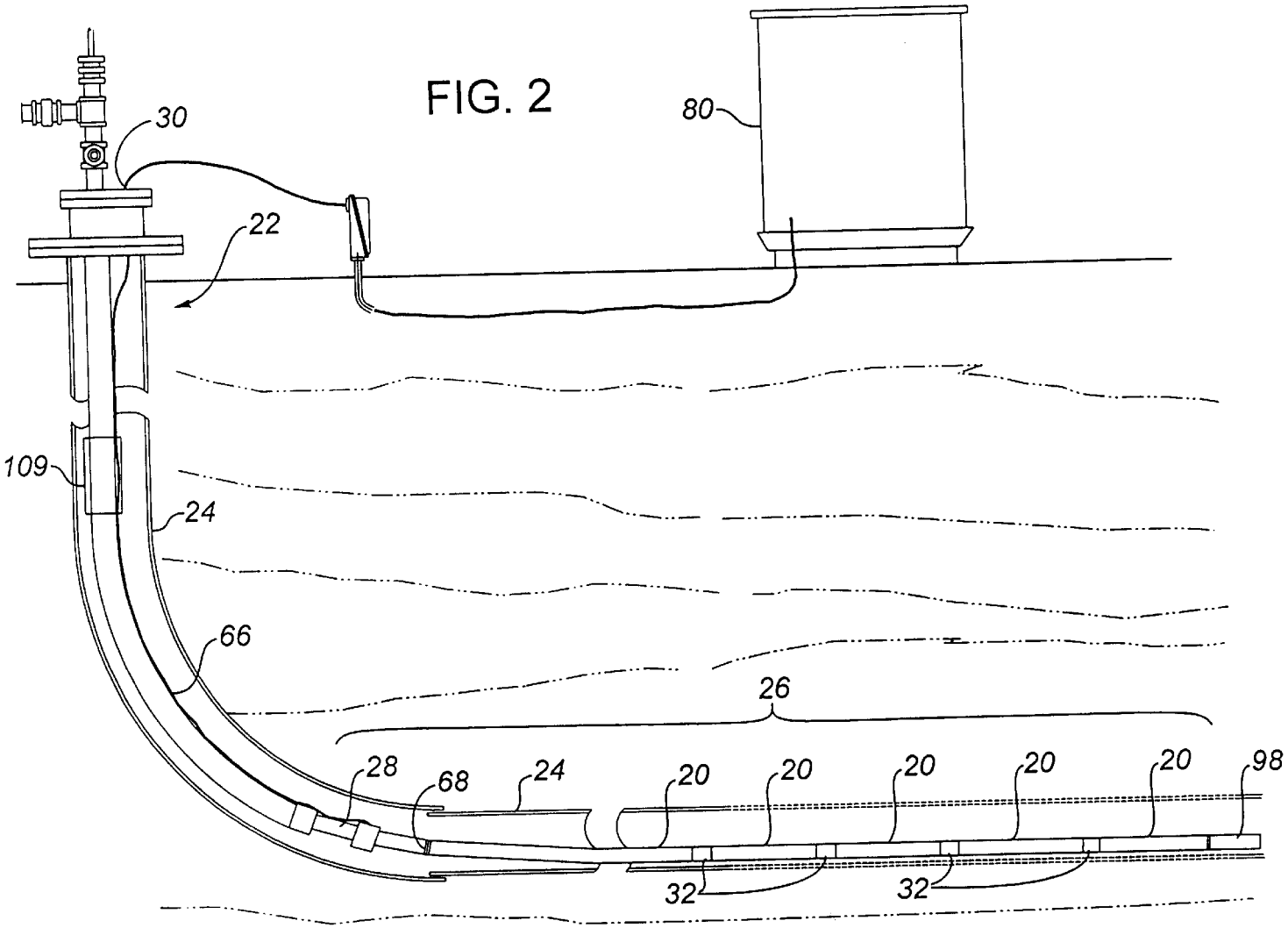
FIG. 2 is a side elevation view, in section, of a magnetic induction assembly positioned in a horizontal well in accordance with the teachings of the present invention, including adapter sub, primary electrical connection, and a plurality of magnetic induction apparatus joined by means of conductive couplings.
Figure 3:
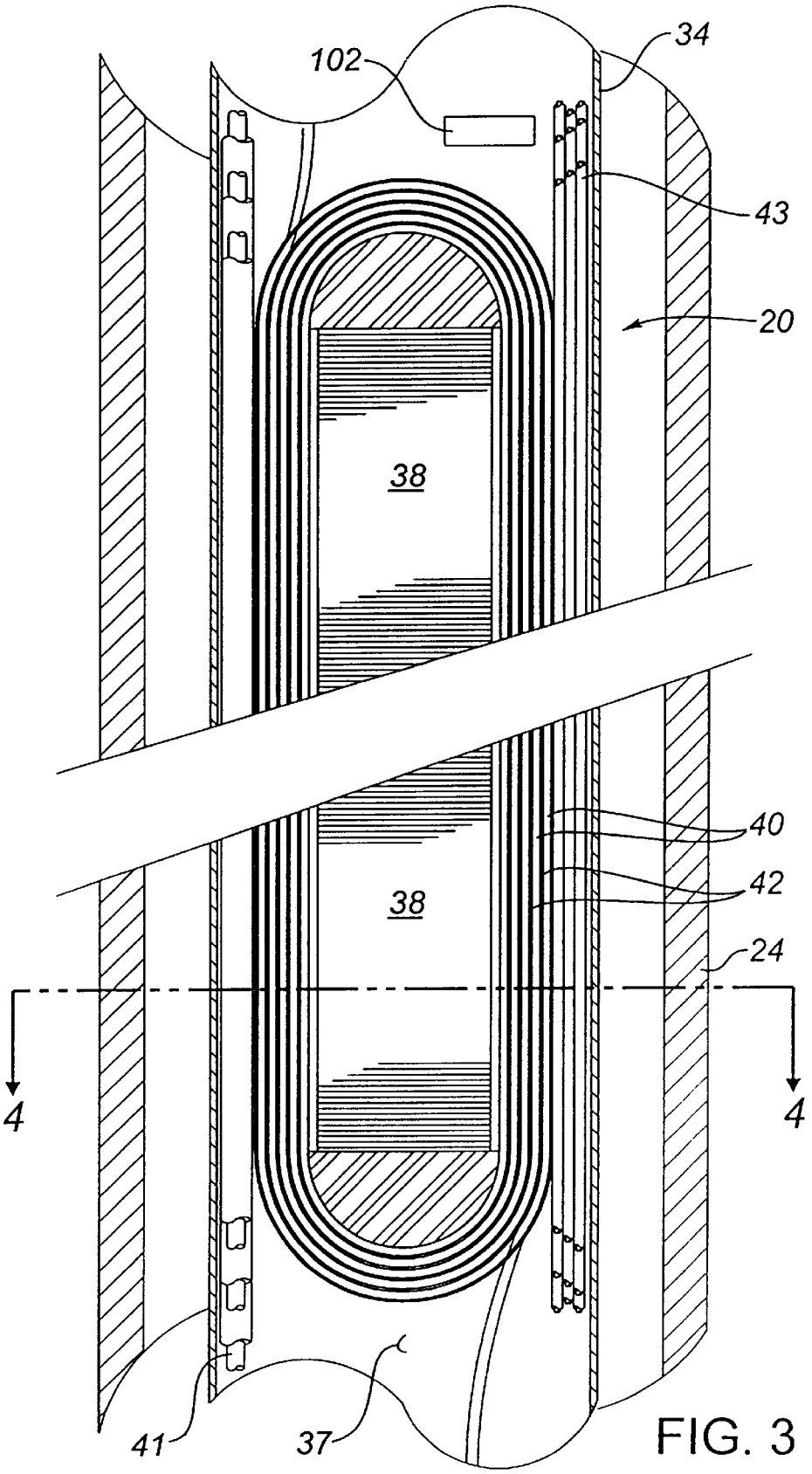
FIG. 3 is a side elevation view, in section, of one of the magnetic induction apparatus from the magnetic induction assembly illustrated in FIG. 1.
Figure 4:
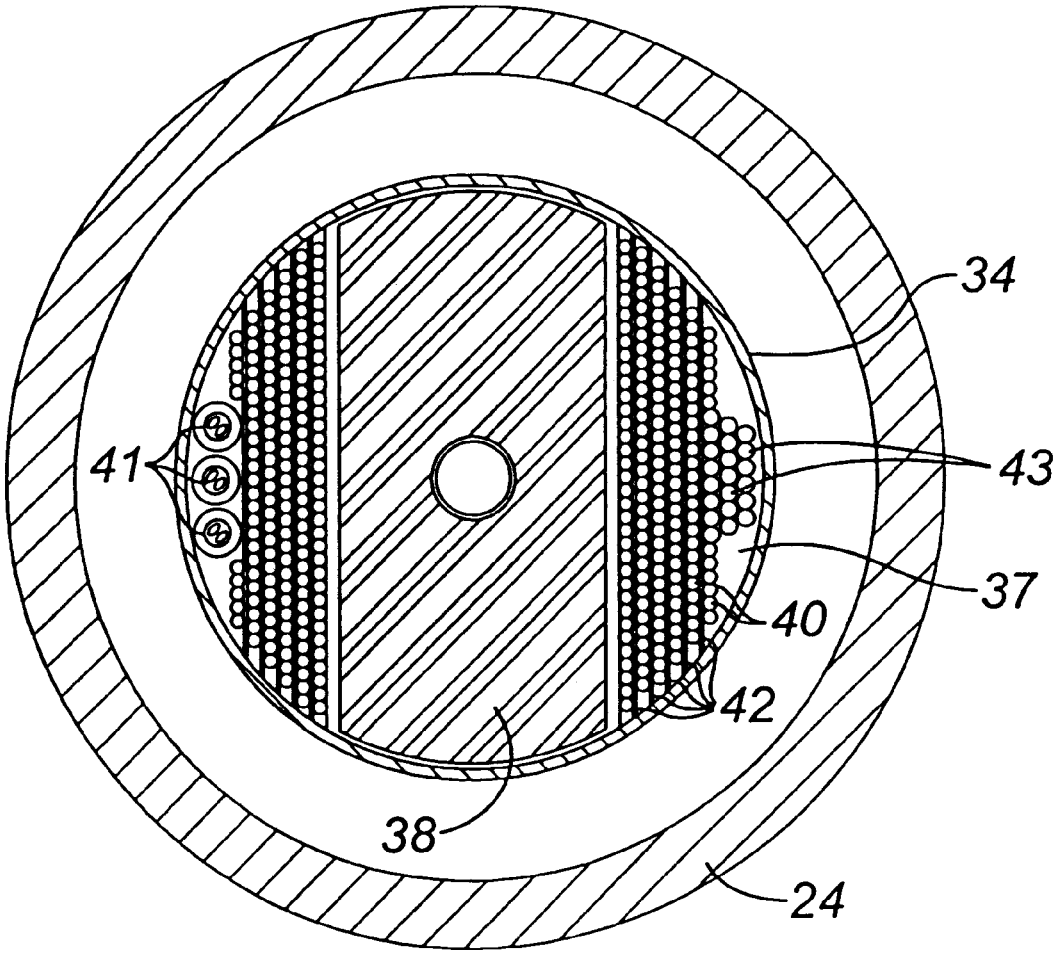
FIG. 4 is a top plan view, in section, taken along section lines 4—4 of the magnetic induction apparatus illustrated in FIG. 3.
Figure 7:
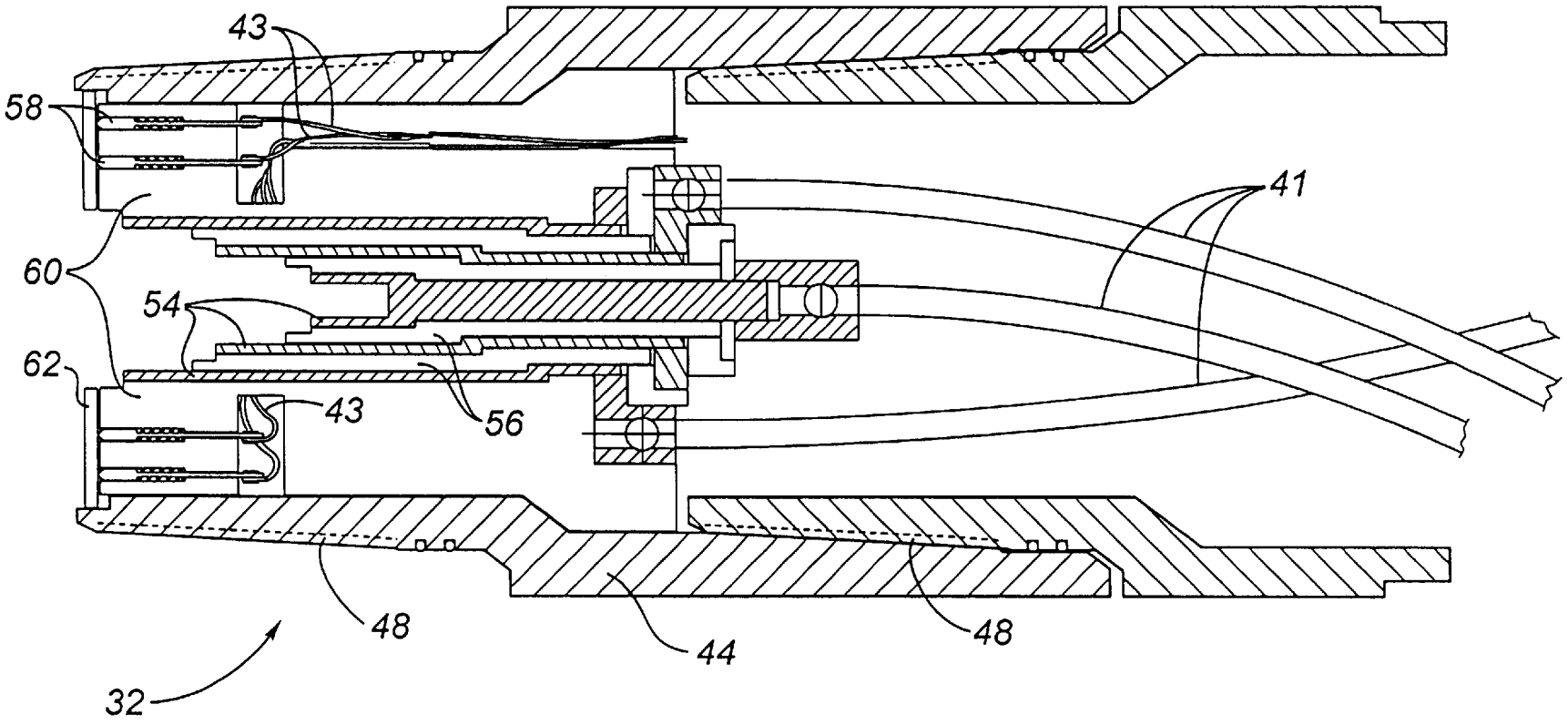
FIG. 7 is a side elevation view, in section, of a male portion of the conductive coupling from the magnetic induction assembly illustrated in FIGS. 1 and 2.
Figure 8:
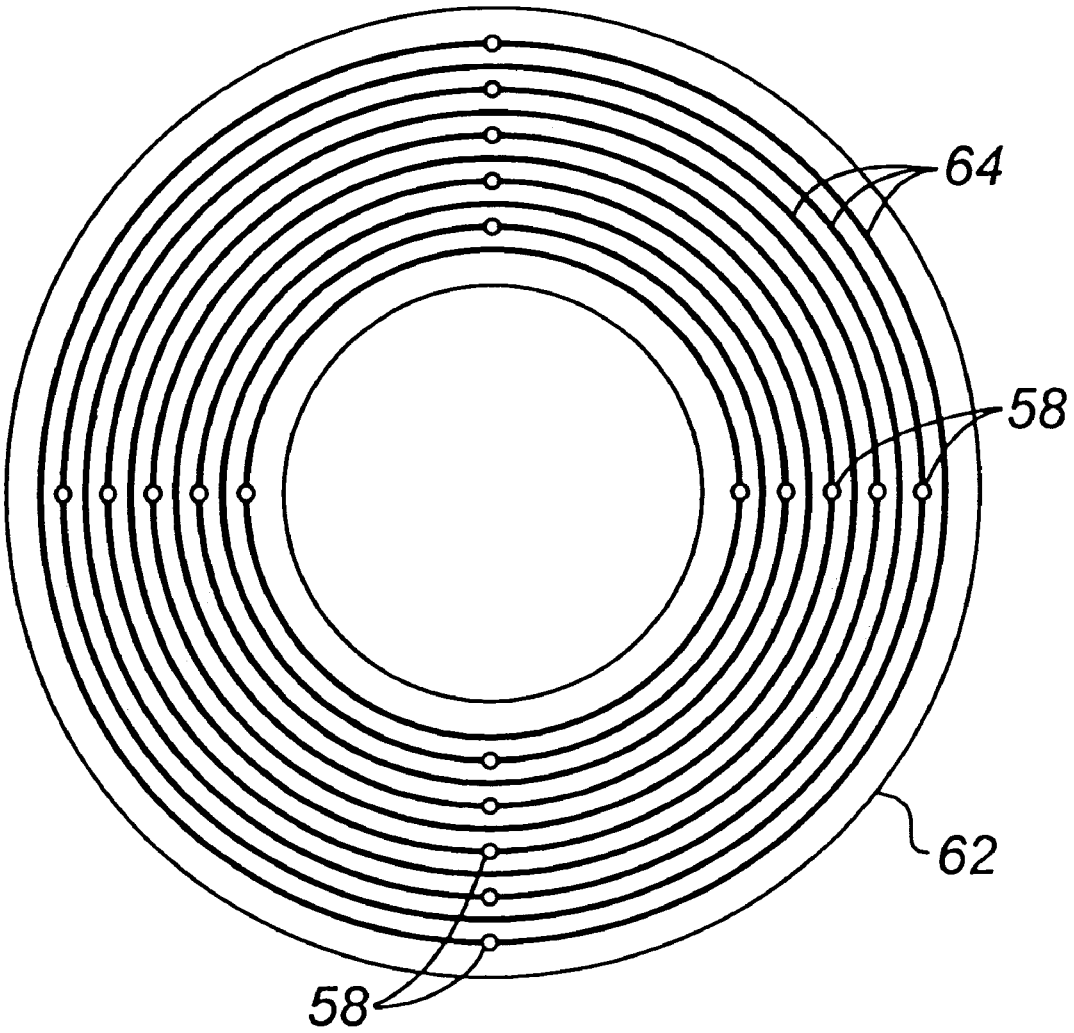
FIG. 8 is an end elevation view of the male portion of the conductive coupling illustrated in FIG. 7.
Figure 9:
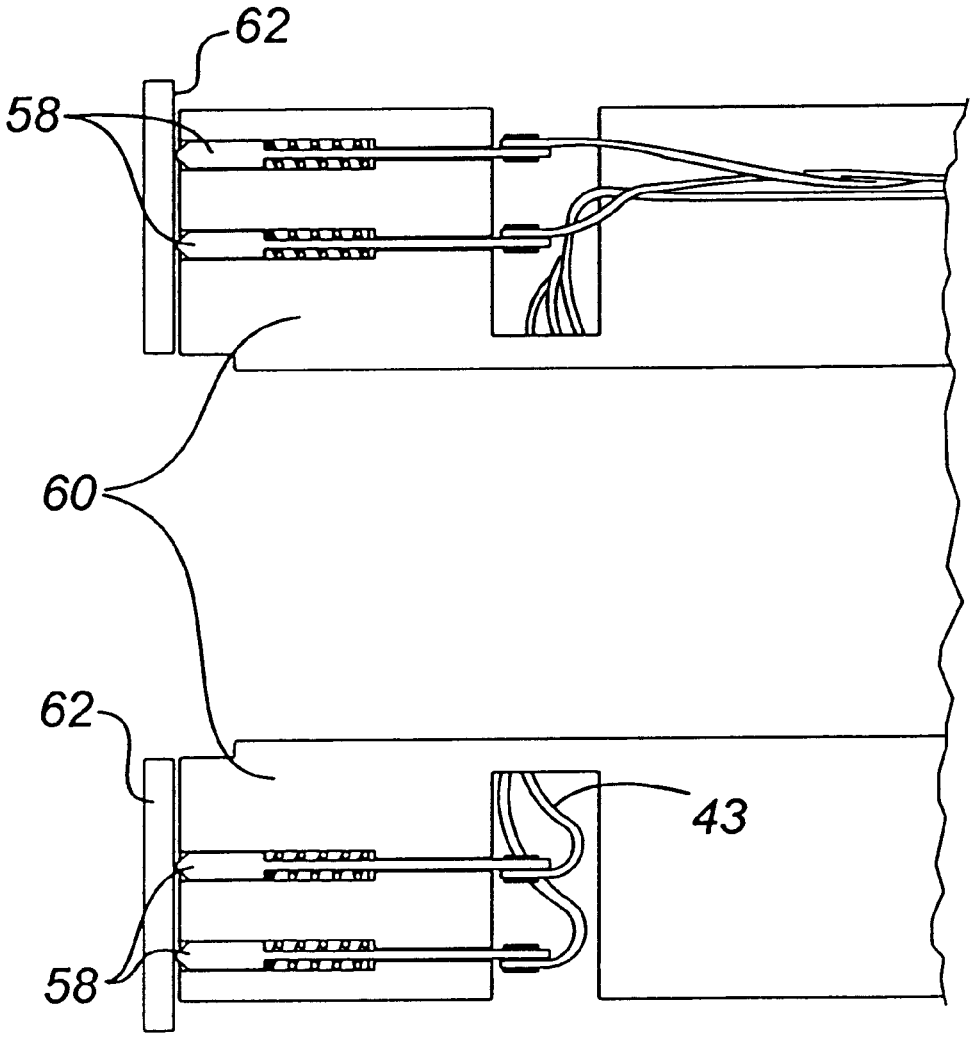
FIG. 9 is a detailed side elevation view, in section, of a portion of the male portion of the conductive coupling illustrated in FIG. 7.
Figure 10:
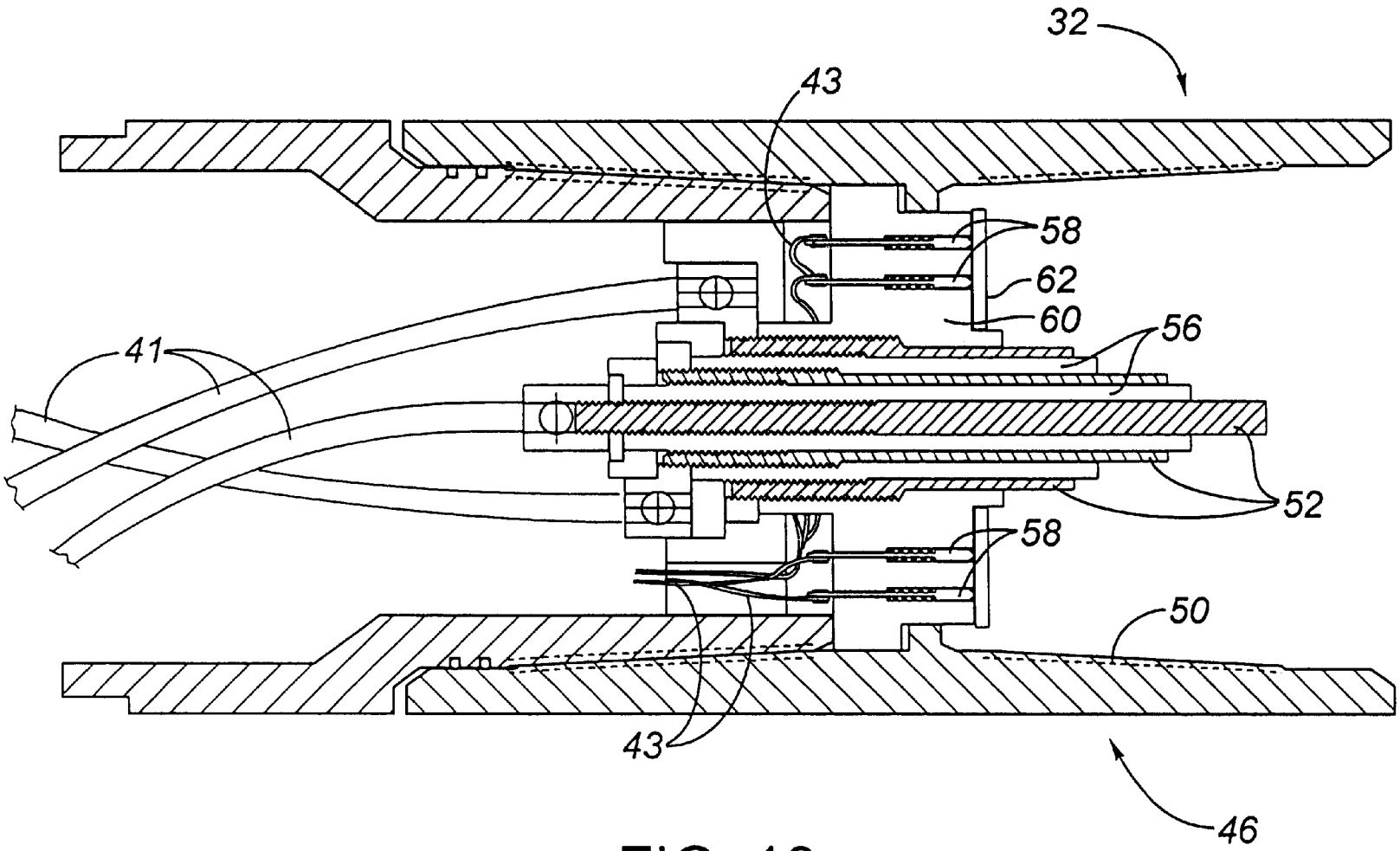
FIG. 10 is a side elevation view, in section, of a female portion of the conductive coupling from the magnetic induction assembly illustrated in FIGS. 1 and 2.
Figure 11:
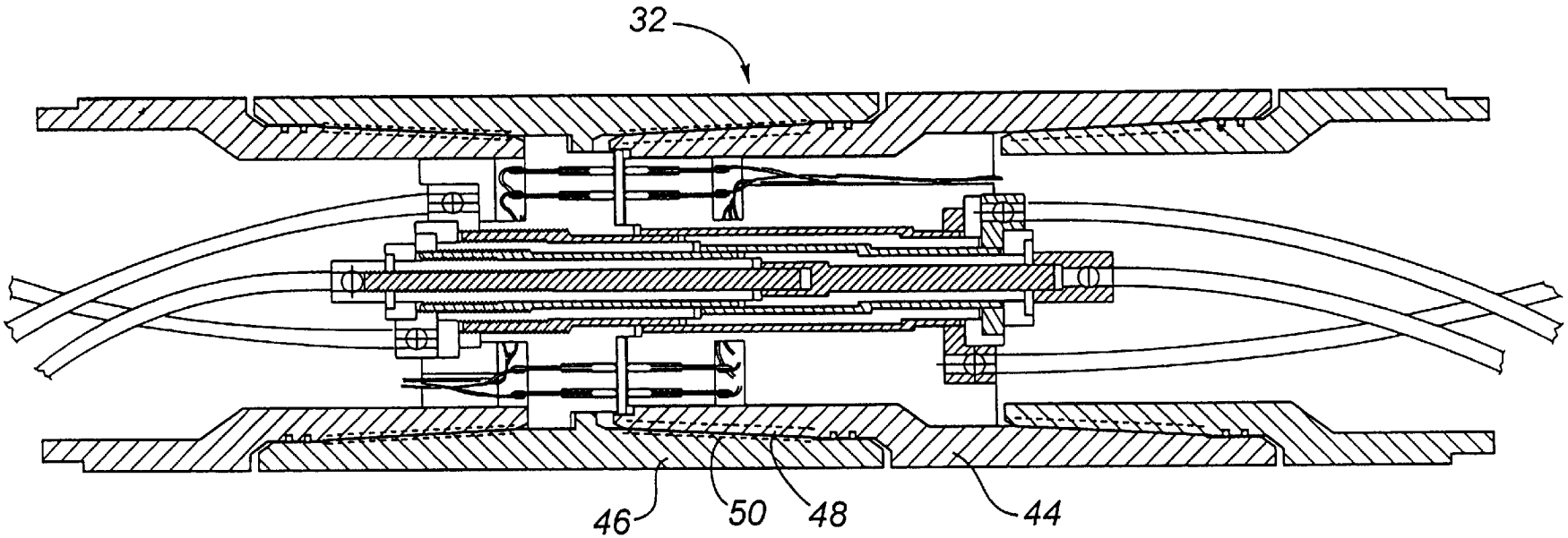
FIG. 11 is a side elevation view, in section, of the male portion illustrated in FIG. 7 coupled with the female portion illustrated in FIG. 10.
Figure 15:
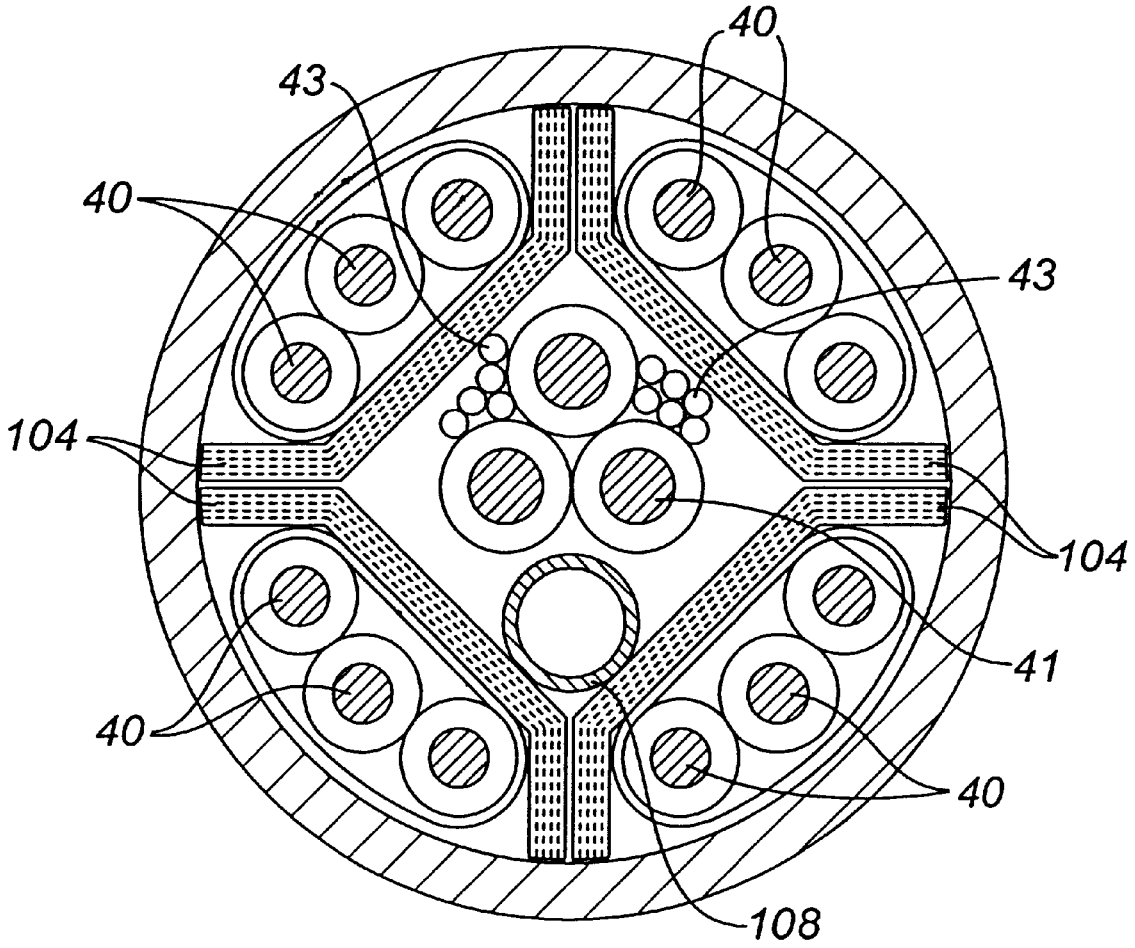
FIG. 15 is an end elevation view, in section, of a first alternative internal configuration for the magnetic induction apparatus illustrated in FIG. 3.
Figure 16:
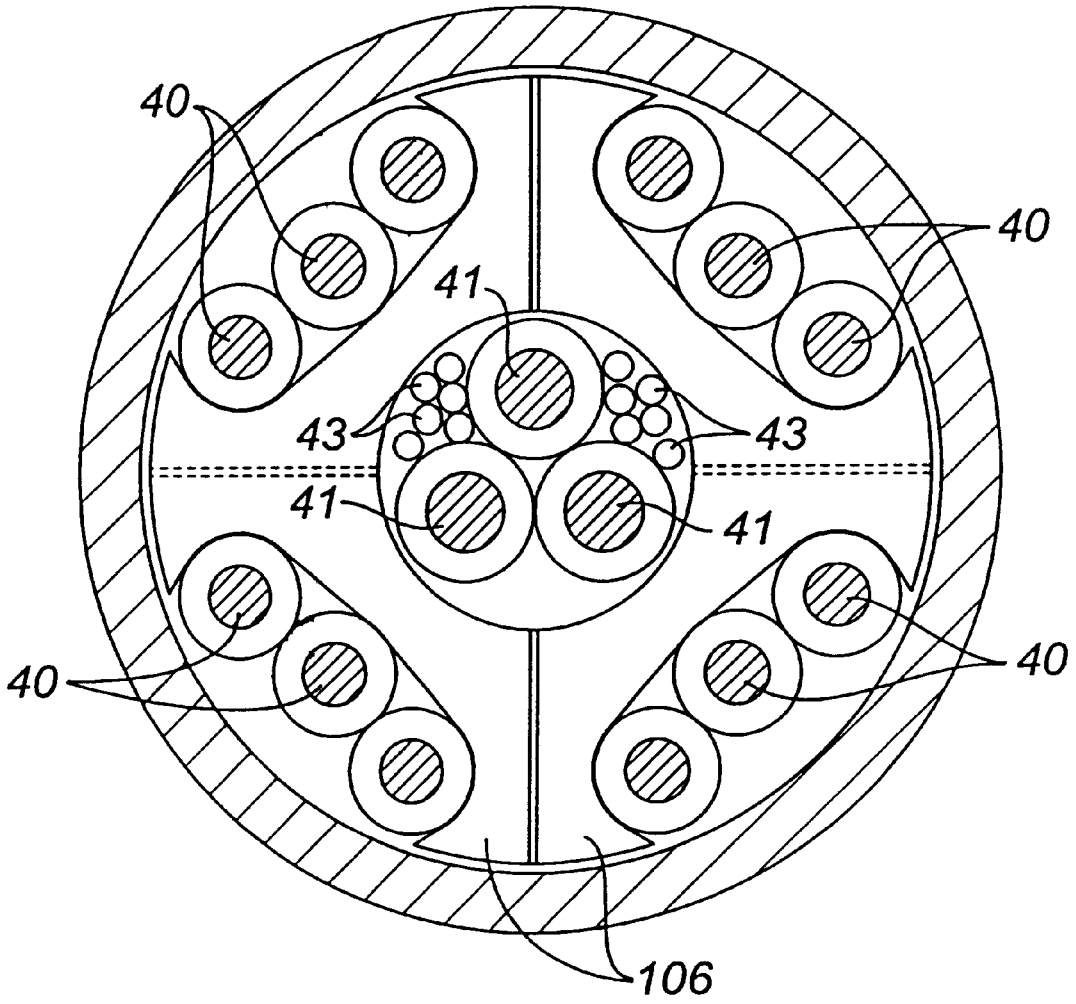
FIG. 16 is an end elevation view, in section, of a second alternative internal configuration for the magnetic induction apparatus illustrated in FIG. 3.
Figure 17:
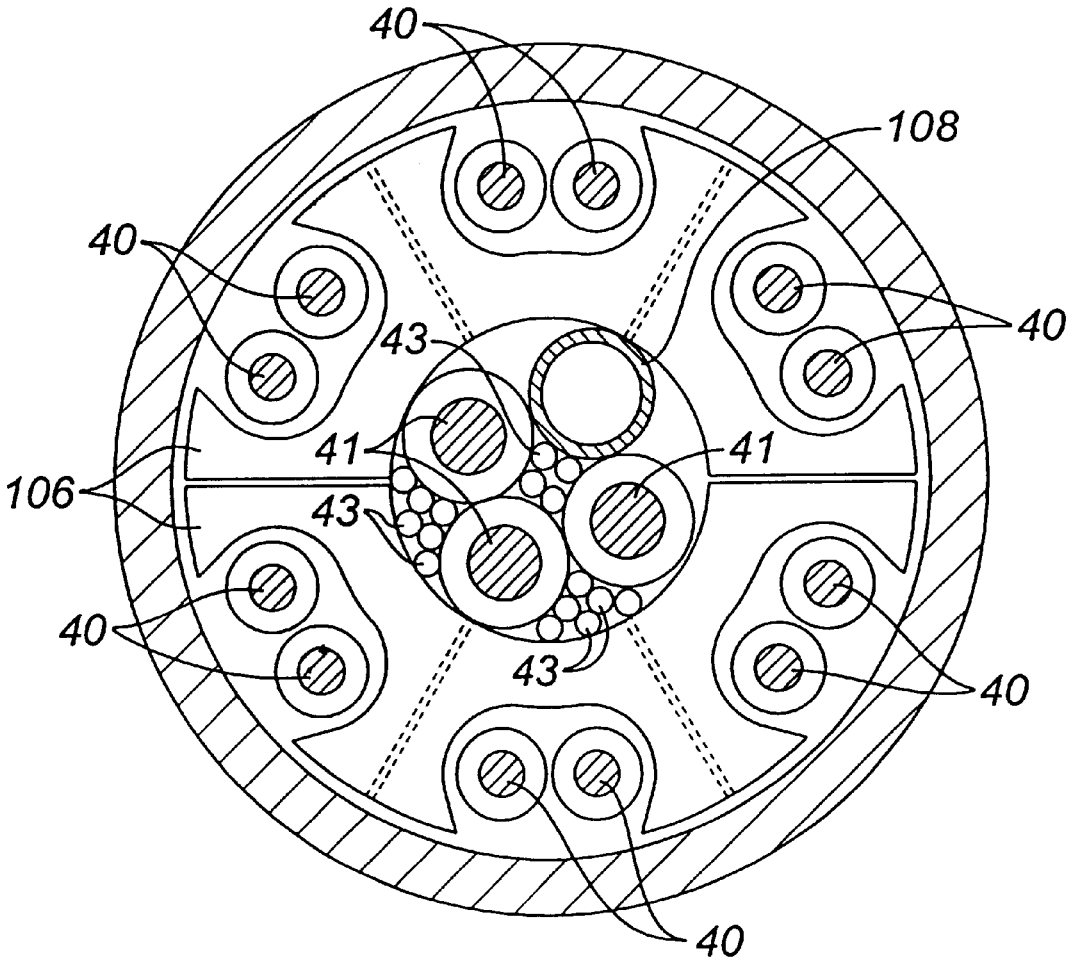
FIG. 17 is an end elevation view, in section, of a third alternative internal configuration for the magnetic induction apparatus illustrated in FIG. 3.

Referring to FIGS. 3 and 4, each magnetic induction apparatus 20 has a tubular housing 34. Housing 34 may be magnetic or non-magnetic depending upon whether it is desirable to build up heat in the housing itself. Referring to FIGS. 1 and 2, it is preferred that housing 34 have external centralizer members 36. Referring to FIGS. 3 and 4, a magnetically permeable core 38 is disposed in housing 34. Electrical conductors 40 are wound in close proximity to core 38. Insulated dividers 42 are used as means for electrically isolating the electrical conductors. It is preferred that housing 34 be filled with an insulating liquid, which may be transformed to a substantially incompressible gel 37 so as to form a permanent electrical insulation and provide a filling that will increase the resistance of housing 34 to withstand high external pressures. The cross sectional area of magnetic core 38, the number of turns of conductors 40, and the current originating from the power control unit may be selected to release the desired amount of heat when stimulated with a fluctuating magnetic field at a frequency such that no substantial net mechanical movement is created by the electromagnetic waves. Supplementally electromechanical motion may be generated when stimulated with a steep rise and fall electrical voltage wave such that the magnetic induction apparatus 20 can respond to magnetic attraction to ferromagnetic well casing 24, thereby causing a motion of magnetic induction apparatus 20 or well casing 24 or both. This motion can be controlled in amplitude by application of a variable voltage and in frequency by the rate of change and reversal of the magnetic field caused by the voltage wave generated at the surface by a Power control unit (PCU). To facilitate connection with the PCU there are power conducting wires 41 and signal conducting wires 43. For reduced heat release, a lower frequency, fewer turns of conductor, lower current, or less cross sectional area or a combination will lower the heat release per unit of length. Sections of inductor constructed in this fashion allow the same current to pass from one magnetic inductor apparatus 20 to another and, since the heat release is proportional to current, overheating in low productivity portions of the production zone can be avoided with series wiring such that full heat release may be achieved in other locations with the same current flow. However, complex wiring configurations are not excluded. The relative strength of mechanical motion may be varied in a similar fashion to suit the particular needs. FIGS. 15, 16, and 17, which will hereinafter be further described, illustrate alternative internal configurations for electrical conductors 40 and core 38. Where close fitting of inductor poles to the casing or liner is practical, additional magnetic poles may be added to the configuration with single or multiple phase wiring through each to suit the requirements. A number of inductors (ie. core 38 with electrical conductors 40) may be contained in housing 34 with overall length to suit the requirements and or shipping restraints. It is preferred, however, that a multiplicity of housings 34 connect several magnetic induction apparatus 20 together to form a magnetic induction assembly 26. Several magnetic induction apparatus 20 are connected together with flanged and bolted joints or with threaded ends similar in configuration and form to those used in the petroleum industry for completion of oil and gas wells. Referring to FIGS. 1 and 2, at each connection for magnetic induction apparatus 20 there is positioned a conductive coupling 32. Conductive coupling 32 may consist of various mechanical connectors and flexible lead wires that complete a conductive connection. A preferred conductive coupling 32 is illustrated in FIG. 11. Referring to FIG. 11, conductive coupling 32 consists of a male portion 44 and a female portion 46 which are coupled together in mating relation. Male portion 44, separately illustrated in FIGS. 7 through 9 has coupling threads 48. Female portion 46, separately illustrated in FIG. 10 has coupling threads 50. Referring to FIG. 10, female portion 46 includes a multiplicity of connector fingers 52. Referring to FIG. 7, male portion 44 includes a multiplicity of telescopically mating sleeves 54 that engage connector fingers 52. Both fingers 52, as illustrated in FIG. 10, and sleeves 54, as illustrated in FIG. 7 are interleaved with insulation 56 to maintain relative positioning and to isolate one from the other with respect to electrical potential. The fingers 52 and sleeves 54 are so proportioned that they do not project beyond a position wherein they may be damaged during the joint make-up operation and further they do not connect one to the other until adequate engagement of coupling threads 48 and 50 ensures that both parts are properly aligned to complete the connection. Referring to FIGS. 7 and 10, insulating blocks 60 surround fingers 52 of female portion 46 and sleeves 54 of male portion 44. A series of spring loaded pins 58 are located within and project outwardly from insulating block 60. Pins 58 are arranged to point toward each other in a radially staggered pattern. Referring to FIGS. 8 and 9, pins 58 engage plates 62 that have circular tracks 64. The radial location of pins 58 is such that each pin 58 follows one of circular tracks 64 during make-up of the joint such that a control signal may pass from one magnetic induction apparatus 20 to the next. Plates 62 are so arranged to contact the appropriate pins 58 of each module at any and all rotational positions. The plates 62 are readily removable to facilitate replacement, if required at each assembly to ensure good contact for the signals.

Where there are two production zones spacer sections (not shown) may be placed between two of magnetic induction assemblies 26. Spacer sections have no inductors, but are equipped with electrical end connectors, as shown and described with reference to FIGS. 7 through 11. This enables power and control signals to pass zones with no oil production capability which are located between two production zones each of which has a magnetic induction assembly 26. Electrical transducer signals pass from magnetic induction apparatus 20 to magnetic induction apparatus 20 through said pins 58 and plates 62.

Figure 12:
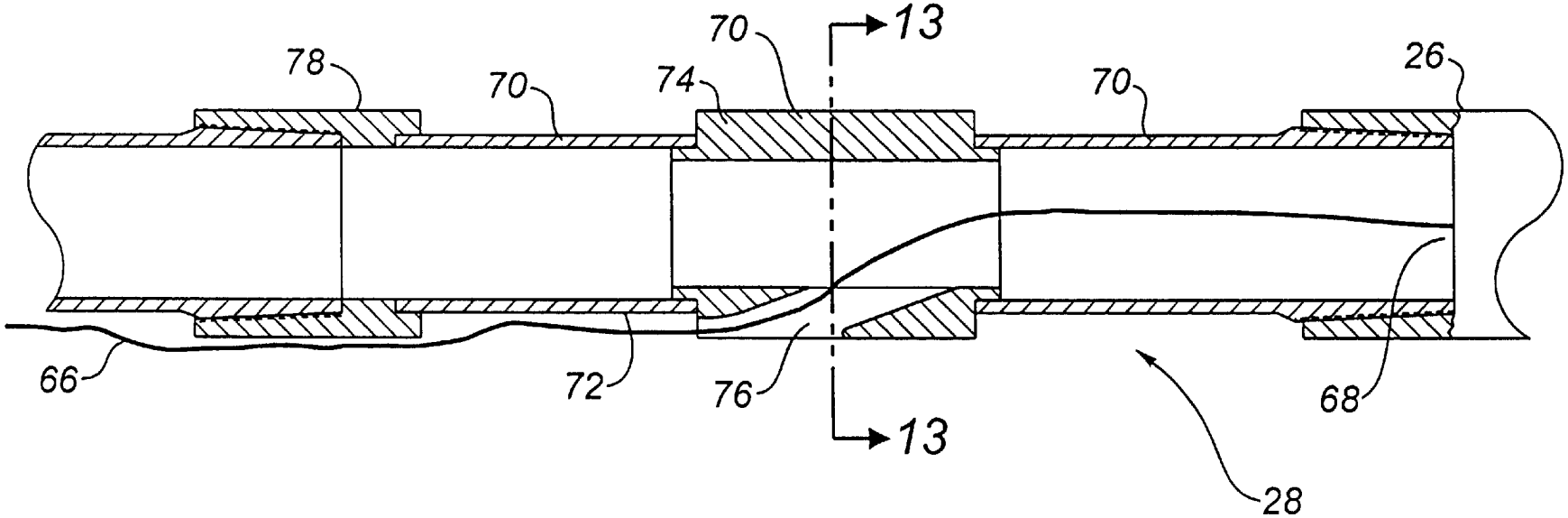
FIG. 12 is a side elevation view, in section, of the adapter sub from the magnetic induction assembly illustrated in FIGS. 1 and 2.
Figure 13:
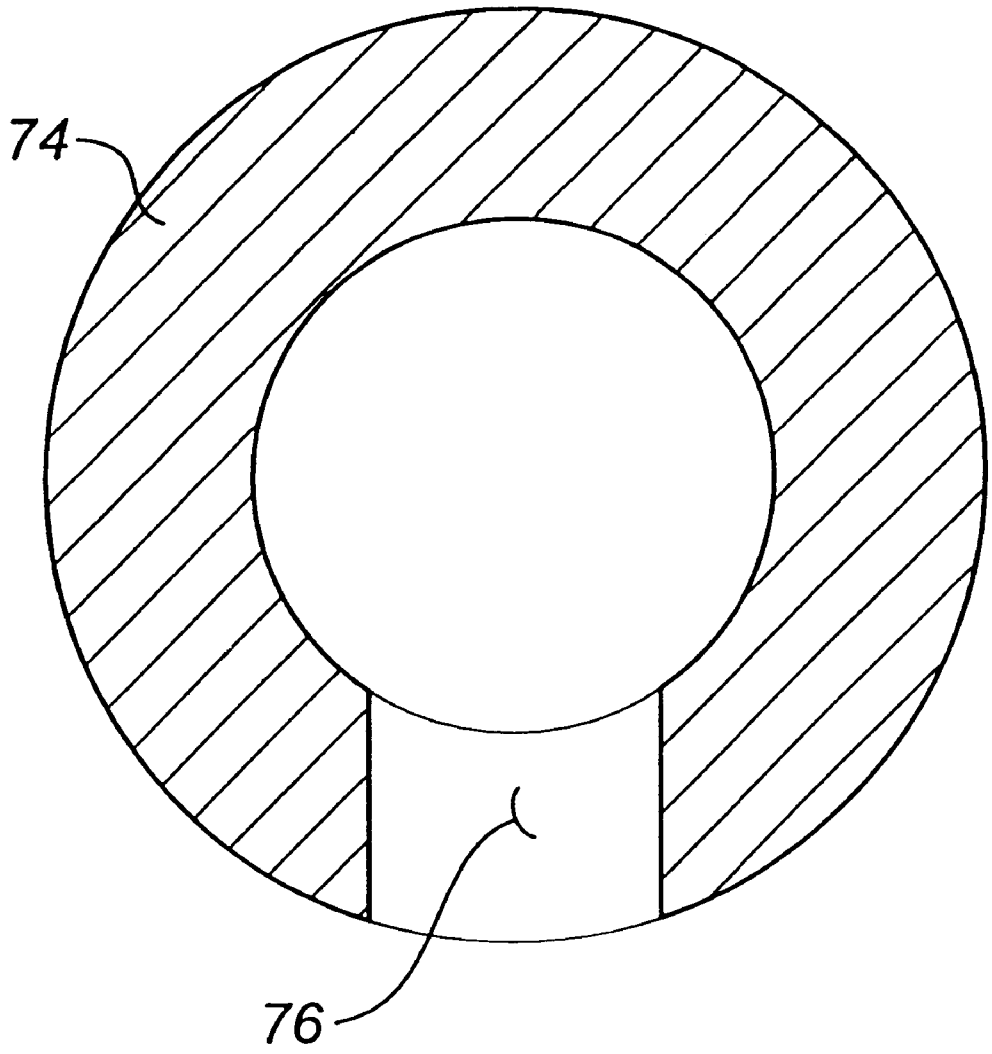
FIG. 13 is an end elevation view, in section, taken along section lines 13—13 of the adapter sub illustrated in FIG. 12.

Referring to FIGS. 12, adapter sub 28 allows Electrical Submersible Pump (ESP) cable 66 to be fed into top 68 of magnetic induction assembly 26. Adapter sub 28 consists of a length of tubing 70 which has an enlarged section 74 near the midpoint such that the ESP cable may pass through tubing 70 and transition to outer face 72 of tubing 70 by passing through a passageway 76 in enlarged section 74, as illustrated in FIG. 13. Adapter sub 28 has a threaded coupling 78 to which the wellbore tubulars (not shown) may be attached thereby suspending magnetic induction assembly 26 at the required location and allowing retrieval of magnetic induction assembly 26 by withdrawing the wellbore tubulars.

Figure 5:
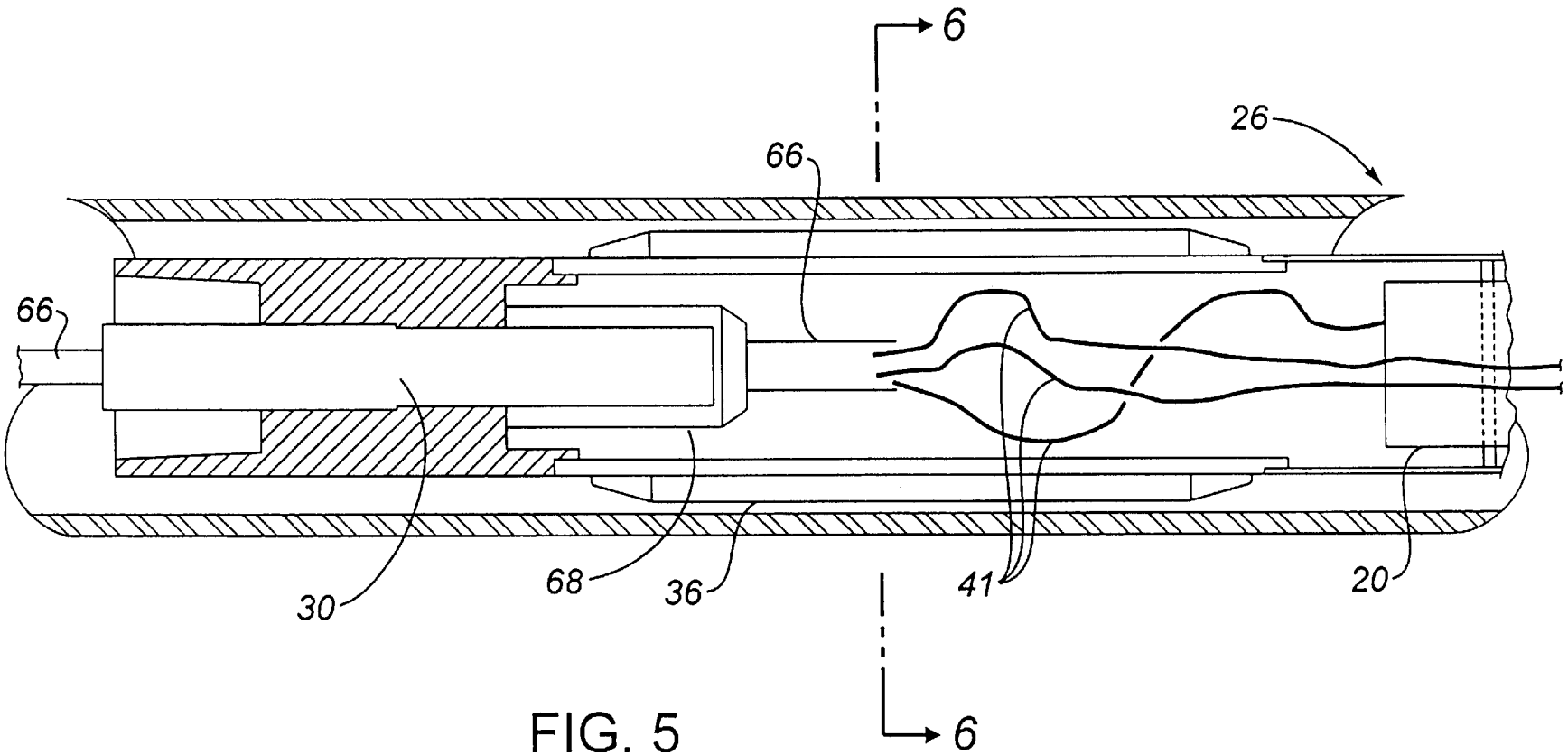
FIG. 5 is a side elevation view, in section, of the primary electrical connection from the magnetic induction assembly illustrated in FIGS. 1 and 2.
Figure 6:
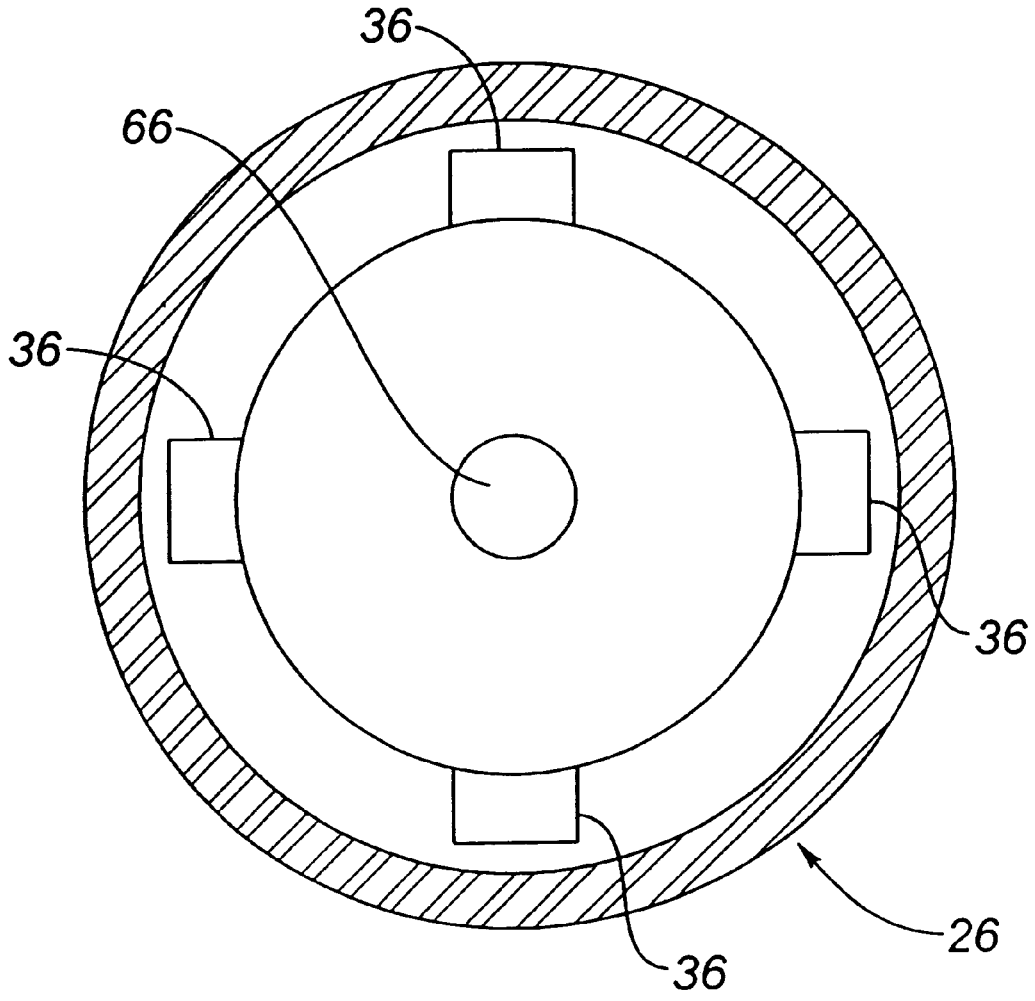
FIG. 6 is an end elevation view, in section, taken along section lines 6—6 of the primary electrical connection illustrated in FIG. 5.

Referring to FIG. 5, ESP cable 66 is coupled to an upper most end 68 of magnetic induction assembly 26 by means of electrical feed through assembly 30. Electrical feed through assembly 30, as illustrated, is manufactured by BIW Connector Systems Inc. There are alternative electrical feed through assemblies sold by Reda Pump Inc. and by Quick Connectors Inc. which may be used. These assemblies are specifically designed for connecting cable to cable, cable through a wellhead, and cable to equipment and the like. The connection may also be made through a fabricated pack-off comprised of a multiplicity of insulated conductors with gasket packing compressed in a gland around said conductors so as to seal formation fluids from entering the inductor container. Electrical feed through assembly 30 as illustrated in FIG. 5, has the advantage that normal oil field thread make-up procedures may be employed thus facilitating installation and retrieval. Use of a standard power feed through allows standard oil field cable splicing practice to be followed when connecting to the ESP cable from magnetic induction assembly 26 to surface. Referring to FIG. 6, feed through assembly has centralizers members 36.

Figure 14:
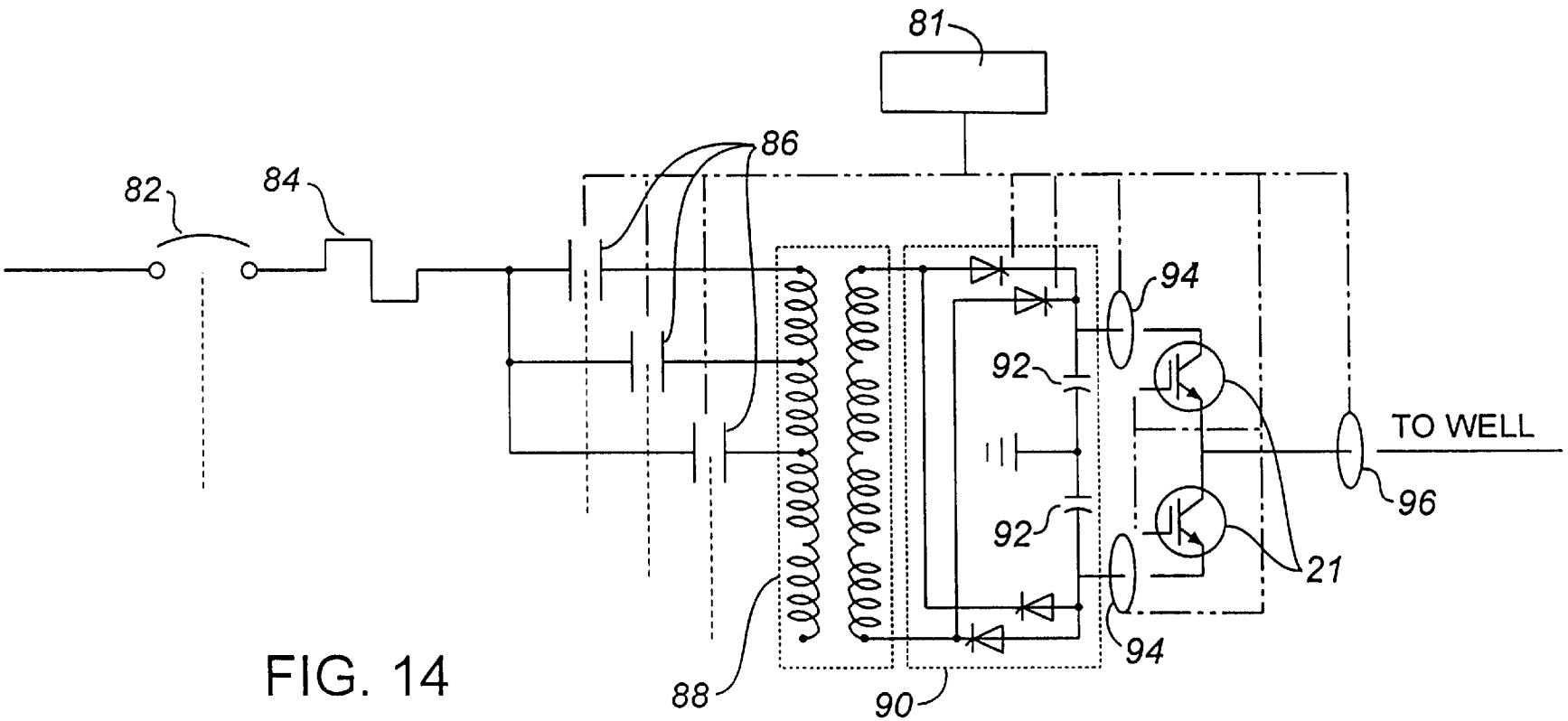
FIG. 14 is a schematic diagram of a power control unit to be used with the magnetic induction assembly illustrated in FIGS. 1 and 2.
Figure 18:
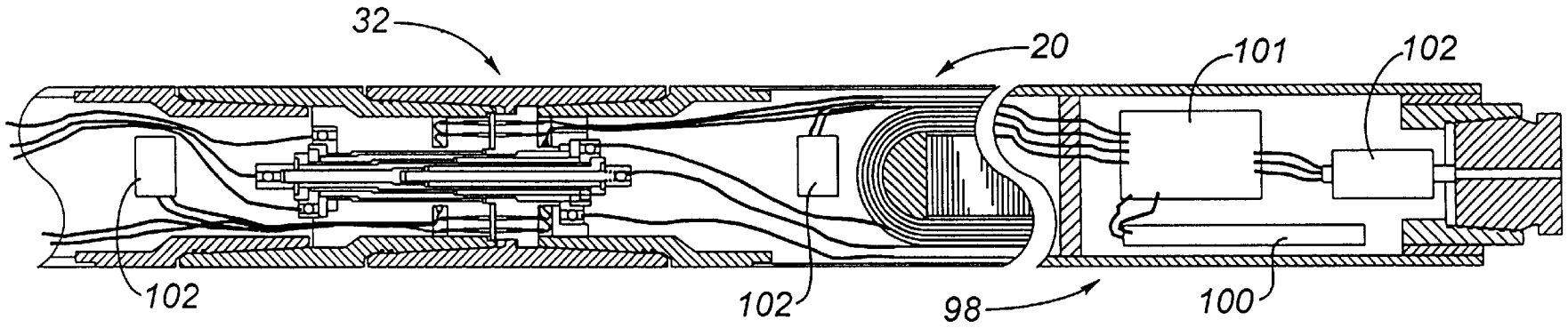
FIG. 18 is a side elevation view, in section, of instrument and sensor components deployed as part of the magnetic induction assembly illustrated in FIGS. 1 and 2.

Referring to FIG. 1 and 2, magnetic induction assembly 26 works in conjunction with a Power Conditioning Unit (PCU) 80 located at surface. PCU 80 utilizes single and multiphase electrical energy either as supplied from electrical systems or portable generators to provide modified output waves for magnetic induction assembly 26. The output wave selected is dependent upon the intended application. Square wave forms have been found to be most beneficial in producing heat. A pulsing wave has been found to be most beneficial in producing vibrations. Maximum inductive heating is realized from waves having rapid current changes (at a given frequency) such that the generation of square or sharp crested waves are desirable for heating purposes. The Heart of the PCU 80 is computer processor 81. It is preferred that PCU 80 also includes solid state wave generating devices such as Silicon Controlled Rectifier (SCR) or Insulated Gate Bipolar Transistor (IGBT) 21 controlled from an interactive computer based control system in order to match system and load requirements. One form of PCU may be configured with a multi tap transformer, SCR or IGBT and current limit sensing on off controls so arranged to turn 60 Hz electrical power on and off in response to fluid flow or lack thereof from the oil well production flow line. This system, while it is inexpensive, has the disadvantage in that it must be set at a power level such that at minimum flow there is no danger of overheating or otherwise damaging the system or well; and is not capable of generating the more effective heating waves or the vibratory motion. The preferred system consists of an incoming breaker, overloads, contactors, followed by a multitap power transformer, an IGBT or SCR bridge network and micro processor based control system to charge capacitors to a suitable voltage given the variable load demands. The output wave should then be generated by a micro controller. The microcontroller can be programmed or provided with application specific integrated circuits, in conjunction with interactive control of IGBT and SCR, to control the output electrical wave so as to enhance the heating action and the vibratory motion as required to maximize conditioning. Operating controls for each phase include anti shoot through controls such that false triggering and over current conditions are avoided and output wave parameters are generated to create the insitu heating or other operations as required. Incorporated within the operating and control system is a data storage function to record both operating mode and response so that optimization of the operating mode may be made either under automatic or manual control. Referring to FIG. 14, PCU 80 includes a supply breaker 82, overloads 84, multiple contactors 86 (or alternatively a multiplicity of Thyristors or Insulated Gate Bipolar Transistors), a multitap power transformer 88, a three phase IGBT or comparable semiconductor bridge 90, a multiplicity of power capacitors 92, IGBT 21 output semiconductor anti shoot through current sensors 94, together with current and voltage sensors 96. PCU 80 delivers single and multiphase variable frequency electrical output waves for the purpose of heating, individual unidirectional output wave, to one or more of magnetic induction apparatus 20, with long period and under current control such that mechanical motion can be induced and the high current in rush of a DC supply can be avoided. PCU 80 is equipped to receive the downhole instrument signals interpret the signals and control operation in accordance with program and set points. PCU is connected to the well head with ESP cable 66, which may also carry the information signals. Referring to FIG. 18, located within each magnetic induction apparatus 20 is an instrument device 98 for the purpose of; receiving AC electrical energy from the inductor supply, so as to charge a battery 100, and which, on signal from PCU 80, commences to sense, in a sequential manner, the electrical values of a multiplicity of transducers 102 located at selected positions along magnetic induction apparatus 20 such that temperatures and pressures and such other signals as may be connected at those locations may be sensed and as part of the same sequence. One or more pressure transducers may be sensed to indicate pressure at selected locations and said instrument outputs a sequential series of signals which travel on the power supply wire(s) to the PCU wherein the signal is received and interpreted. Said information may then be used to provide operational control and adjust the output and wave shape to affect the desired output in accordance with control programs contained within the PCU computer and micro controllers.

FIGS. 15 through 17 illustrate alternative internal configuration for core 38 and electrical conductors 40 illustrated in FIG. 4. FIG. 15 illustrates a configuration that was developed using a series of transverse plates 104 which allow magnetic induction apparatus 20 to flex. The flexing is desirable in order to build angle to get around a corner when the oil well has a horizontal or deviated portion. FIGS. 16 illustrates a configuration developed with a series of thin laminations 106 that are preferably twisted into a helical configuration. The helical configuration causes physical displacement of the string during operation, such that the annular space within the wellbore is stirred. This minimizes the tendency for sand and particulate matter to settle to the bottom of the hole, resulting in increased availability for production. FIG. 17 illustrates a configuration that was developed to accommodate a flow tube 108. This allows passing liquids through concentric flow tube 108 for the purpose of flushing or cleansing the wellbore.

Figure 19:
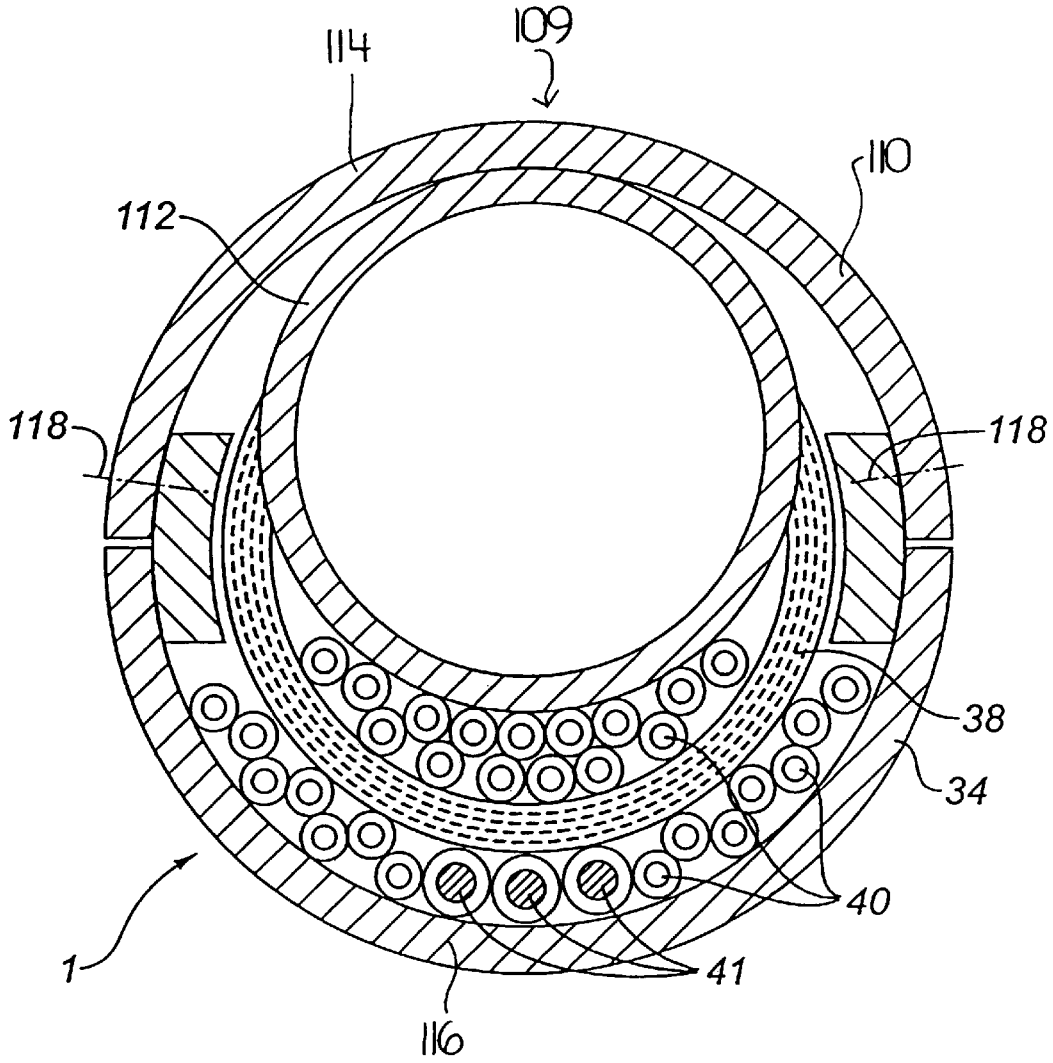
FIG. 19 is an end elevation view, in section, of a production tubing heater illustrated in FIGS. 1 and 2.

When oil is raised to surface, paraffin wax and the like tend to precipitate out and adhere to the walls of the production tubing. This can be addressed through the teaching of the present invention. Referring to FIG. 19, there is illustrated a production tubing heater, generally identified by reference numeral 109. This configuration has an outer tubing 110 and an inner production tubing 112. Outer tubing comes in two semi-circular sections 114 and 116 which fit around production tubing 112 and are held in place by clamps 118. Core 38 and electrical conductors 40 are disposed between outer tubing 110 and inner production tubing 112. When power passes through core 38, heat is generated which heats production tubing 112.

There are a variety of reasons why subterranean thermal conditioning may be employed:

In an oil well:

a) Heating of the casing, reservoir rock, and reservoir fluids in the near wellbore vicinity may be employed in order to reduce the viscosity of the fluids flowing in the region such that near wellbore pressure drop is reduced and fluid production is stimulated;

b) Heating of the casing reservoir rock, and reservoir fluids in the near wellbore may be employed to dissolve precipitated solids like paraffin wax, asphaltines and resins which impede the well's productivity, and to prevent the precipitation of these solids from recurring;

c) Heating of the casing, reservoir rock, and reservoir fluids in the near well bore may be employed to mitigate the effect of rock permeability reduction caused by an invasion of well drilling fluids into the rock or by similar processes which forms a "skin" or "skin damage" forming an impediment to oil production;

d)It may also be employed for the in situ heating of solvents or diluents injected intermittently or continuously for the purpose of removing precipitated solids such as paraffin wax from the well's perforations, production tubing and pump;

e) Heating of sections of the production tubing may be employed in order to dissolve precipitated solids such as paraffin wax or gas hydrates and prevent the recurrence of such precipitation which impedes production; and f) Heating of produced fluids in the well in order to reduce their viscosity and thereby enhance the efficiency and operability of the well's pumping system.

In a gas well:

a) Heating of the casing and reservoir in the near wellbore region may be employed to remove or mitigate the production limiting effect of heavy oil or asphaltines which are carried by the gas moving through the reservoir and deposited in the near wellbore;

b) In wells that produce gas with high concentrations of hydrogen sulfide, heating of the casing, reservoir rock and reservoir fluids in the near wellbore region may be employed to dissolve precipitated elemental sulphur and to prevent such precipitation from occurring; and c) In wells that produce gas with high concentrations of hydrogen sulfide, heating of sections of the production tubing may be employed to dissolve precipitated elemental sulphur and preventing its recurrence.

There are also beneficial effects to be obtained from the thermal conditioning of injection wells. Thermal conditioning can be used to heat, in situ, the fluid being injected into the well near its desired entry point into the target formation.

This improves the injectability of the fluid or enhances its properties once it is in the formation. For example, thermal conditioning would improve the solvent properties of water in solution mining of potash. It would also improve the effectiveness of an injected fluid used to sweep residual oil from a pressure depleted reservoir.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. An apparatus for subterranean thermal conditioning comprising:

a tubular housing;

a magnetically permeable core disposed within the housing;

electrical conductors wound in close proximity to the core; and means for electrically isolating the electrical conductors, and the means for electrically isolating the electrical conductors including an insulating liquid.

2. An apparatus for subterranean thermal conditioning comprising:

a tubular housing;

a magnetically permeable core disposed within the housing;

electrical conductors wound in close proximity to the core; and means for electrically isolating the electrical conductors, and the means for electrically isolating the electrical conductors including a substantially incompressible insulating gel.

3. An apparatus for subterranean thermal conditioning comprising:

a tubular housing;

a magnetically permeable core disposed in the housing;

electrical conductors positioned within the tubular housing and wound directly onto the core thereby forming an inductor which heats the housing by inducing electromagnetic flux from within the housing;

means for electrically isolating the electrical conductors;

the core, the electrical conductors and the means for electrically isolating the electrical conductors substantially filling the housing;

means being provided for electrically connecting a plurality of housings to form a magnetic induction assembly; and each housing has a female coupling at one end with interior coupling threads and a threaded male coupling at an opposed end with exterior coupling threads, the female coupling of one housing being adapted to receive the male coupling of an adjacent housing with the exterior coupling threads mating with the interior coupling threads, each female coupling having several axially projecting fingers, and each male coupling having an equal number of receiving sleeves adapted to receive the projecting fingers of the female coupling.

4. An apparatus for subterranean thermal conditioning comprising:

a tubular housing;

a magnetically permeable core disposed in the housing;

electrical conductors positioned within the tubular housing and wound directly onto the core thereby forming an inductor which heats the housing by inducing electromagnetic flux from within the housing;

means for electrically isolating the electrical conductors;

the core, the electrical conductors and the means for electrically isolating the electrical conductors substantially filling the housing; and the core includes several transversely positioned flex plates thereby accommodating flexing of the housing.

* * * * *